US011944896B2

(12) United States Patent
Molyneux et al.

(10) Patent No.: US 11,944,896 B2
(45) Date of Patent: Apr. 2, 2024

(54) SKATEBOARD AND SKATEBOARD TRUCKS

(71) Applicant: MTMX Corporation, Inc., Santa Barbara, CA (US)

(72) Inventors: Mike Molyneux, Santa Barbara, CA (US); Mark Andrew Slagter, Palos Verdes Estates, CA (US); Carl Victor deCiutiis, Rancho Palos Verde, CA (US)

(73) Assignee: MTMX, LLC, Santa Barbara, CA (US)

( * ) Notice: Subject to any disclaimer, the term of this patent is extended or adjusted under 35 U.S.C. 154(b) by 0 days.

(21) Appl. No.: 17/733,775

(22) Filed: Apr. 29, 2022

(65) Prior Publication Data

US 2022/0258032 A1 Aug. 18, 2022

Related U.S. Application Data

(63) Continuation-in-part of application No. 16/922,867, filed on Jul. 7, 2020, now Pat. No. 11,318,364.

(60) Provisional application No. 62/921,798, filed on Jul. 8, 2019.

(51) Int. Cl.
*A63C 17/01* (2006.01)

(52) U.S. Cl.
CPC ..... *A63C 17/012* (2013.01); *A63C 17/015* (2013.01)

(58) Field of Classification Search
CPC ..... A63C 17/0093; A63C 17/012
See application file for complete search history.

(56) References Cited

U.S. PATENT DOCUMENTS

| | | | | |
|---|---|---|---|---|
| 4,245,848 | A | 1/1981 | Dudouyt | |
| 6,315,304 | B1 | 11/2001 | Kirkland | |
| 7,219,907 | B2 | 5/2007 | Chang | |
| 7,316,408 | B2 | 1/2008 | McClain | |
| 8,328,206 | B2 | 12/2012 | Williams, Jr. | |
| 8,783,699 | B2 | 7/2014 | Gesmer | |
| 9,144,730 | B1 * | 9/2015 | Visinski | A63C 17/0093 |
| 10,335,667 | B2 | 7/2019 | Martinez Almansa | |

(Continued)

OTHER PUBLICATIONS

Office Action dated Jun. 30, 2021 for U.S. Appl. No. 16/922,867 (pp. 1-9).

(Continued)

*Primary Examiner* — Brian L Swenson
(74) *Attorney, Agent, or Firm* — Jaye G. Heybl

(57) ABSTRACT

Skateboard trucks and skateboards using the improved trucks are disclosed. Truck according to the present invention can comprising a hanger with wheels. A base assembly is included having an at least partially hollow housing section. The hanger is rotationally mounted to the base assembly. The hanger also comprises a hanger portion that is within partially hollow housing section. Compressible spring elements are included within the partially hollow housing section, wherein the hanger portion operates on the compressible spring elements when the hanger rotates in relation to the base assembly. Skateboards are also disclosed that utilize the truck. One or more trucks are mounted to the skateboard deck with the truck having internal compressible spring elements that are compressed when turning the skateboard. The internal compressible spring elements also expand to return the truck to a neutral position when the skateboard is not turning.

18 Claims, 10 Drawing Sheets

(56) References Cited

U.S. PATENT DOCUMENTS

| | | | | |
|---|---|---|---|---|
| 10,384,116 | B1 * | 8/2019 | Yeh | A63C 17/015 |
| 11,103,767 | B1 * | 8/2021 | Yamano | A63C 17/012 |
| 11,224,793 | B1 * | 1/2022 | Piumarta | A63C 17/0093 |
| 2001/0038187 | A1 | 11/2001 | Reyes | |
| 2002/0011713 | A1 | 1/2002 | Kirkland | |
| 2005/0012290 | A1 | 1/2005 | McClain | |
| 2007/0164530 | A1 | 7/2007 | Horn | |
| 2011/0210526 | A1 | 9/2011 | Williams, Jr. | |
| 2013/0069331 | A1 | 3/2013 | Yamada | |
| 2015/0097352 | A1 | 4/2015 | Ivazes | |
| 2017/0203193 | A1 * | 7/2017 | Powell | A63C 17/015 |
| 2019/0255423 | A1 * | 8/2019 | Tyler | A63C 17/0046 |

OTHER PUBLICATIONS

Office Action (Notice of Allowance and Fees Due (PTOL-85)) dated Jan. 13, 2022 for U.S. Appl. No. 16/922,867 (pp. 1-9).

International Preliminary Report on Patentability for App. No. PCT/US2020/041076, dated Jan. 20, 2022, 8 pages.

* cited by examiner

SKATEBOARD AND SKATEBOARD TRUCKS

This application is a continuation-in-part of and claims the benefit of U.S. patent application Ser. No. 16/922,867, filed on Jul. 7, 2020, which claims the benefit of U.S. Provisional Patent Application Ser. No. 62/921,798, filed on Jul. 8, 2019.

BACKGROUND OF THE INVENTION

Field of the Invention

This invention is directed towards the field of recreational and exercise vehicles and in particular, skateboards and mechanisms used in skateboards.

Description of Related Art

The sport of skateboarding first started when surfers took the trucks and wheels off of roller-skates and screwed them to a piece of plywood to try to simulate surfing on pavement, even though the surfaces of water and pavement are very different. A surfboard has curvature to the bottom plane of the board called rocker and shaped side rails. The rider carves turns through the water by balancing properly above the surfboard, tilting over the surfboard, submerging the rail into the water, and allowing the rocker to create the arc of a turn. The fin/fins of a surfboard, which are located towards the back bottoms-side of the board where there is less rocker help to keep the board from skipping on top of the water. By shifting weight side to side and front to back, the surfer is able to turn, accelerate and stall the surfboard to control his position in the water.

Conventional skateboard and skateboard truck mechanisms crudely simulate surfing. By tilting the skateboard deck in a similar fashion as surfing, the rider is able to turn the font wheels of the board in the direction of the "tilt" and the back wheels in the opposite direction, thusly carving a more regular arc shaped path along the pavement. Polyurethane wheels grip the pavement to help keep the skateboard from sliding during a turn. Conventional skateboard trucks can be provided with a mechanism for the trucks to be tightened or loosened, which results in the skateboard requiring more or less tilt force to turn the skateboard.

The modern evolution of skateboarding has veered from its origins of simulating surfing into two major directions, both having less to do with carving turns, and more to do with skateboard tricks performed in bowls and on sidewalk street skating. Most of the tricks are performed with the skateboard trucks cranked tight which limits the amount of turning capabilities and gives riders more stability for "landing" a variety of tricks, many of which involve the skateboard leaving with the ground.

More recently a trend in longboarding has arisen which is less focused on the ability to do flip tricks, and more on the original concept of carving turns and simulating surfing. A few recent inventions such as the one developed by Carver, Gullwing and Rojas provide skateboard trucks that allow greater mobility. Many of these new devices (as well as the common skateboard truck design) have a problem with wheel bite, whereby the front wheels come in contact with the skateboard deck creating an instant stop usually resulting in a dangerous situation where the rider falls. This problem is normally solved by tightening down the truck and limiting its turning ability, or by putting spacers between the deck and truck resulting in a board that is extremely high off the ground with a high center of gravity and high level of instability.

SUMMARY OF THE INVENTION

The present invention is directed to improved skateboard trucks and skateboards using the improved trucks. One embodiment of a skateboard truck according to the present invention comprises a hanger with wheels and a base assembly having an at least partially hollow housing section. The hanger is rotationally mounted to the base assembly, with the hanger comprises a hanger portion within the at least partially hollow housing section. An integral bushing is included within the at least partially hollow housing section, wherein the hanger portion operates on the integral bushing when the hanger rotates in relation to the base assembly.

Another embodiment of a skateboard truck according to the present invention comprises a hanger rotatably mounted to a base assembly and a bushing internal to said base assembly. The bushing at least partially comprises a compressible material, wherein a turning force on the hanger causes the hanger to rotate in relation to the base assembly, which causes compression of least part of said bushing. Wherein removal of said turning force allows at least a portion of the bushing to expand to cause the hanger to return to a neutral position in relation to the base assembly.

Other advantages of this invention will become apparent from the following description taken in junction with the accompanying drawings wherein are set forth, by way of illustration and example, certain embodiments of this invention. The drawings constitute a part of this specification and include exemplary embodiments of the present invention and illustrate various features thereof.

DETAILED DESCRIPTION OF THE INVENTION

Figure 1:
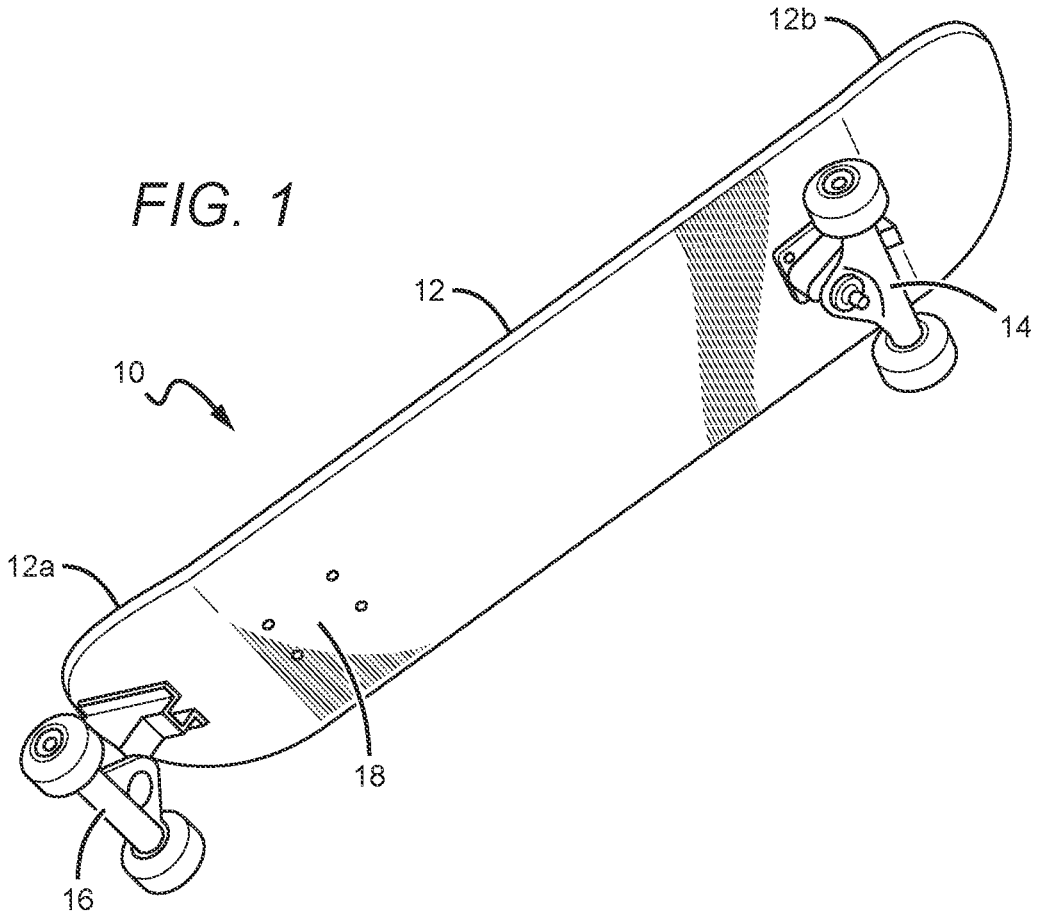
FIG. 1 is a bottom perspective view of one embodiment of a skateboard according to the present invention.

The present invention is generally directed to different embodiments of improved skateboard trucks and improved skateboards using those trucks. The trucks according to the present invention provide for a smoother, quieter and more gradual turning action compared to a conventional truck. Some skateboards according to the present invention place one of these trucks closer to the nose of the skateboard deck. This provides certain advantages as discussed below including but not limited to, lowering the center of gravity By making this nose truck capable of more loosely turning, in conjunction with a stiffer standard back truck mounted, a skateboard is provided that has a closer feel to a surfboard and the lower center of gravity can provide easier use and greater stability. The skateboards and trucks according to the present invention can also provide other advantages as discussed below.

Some embodiments of a truck according to the present invention can provide improved operating characteristics by having internal compression and recoil mechanisms. Turning of the skateboard causes and internal compression action, and releasing of this turning force allows for the compression to be removed and the truck is returned to its neutral position. In some embodiment, the trucks can have internal compressible rods that provide this compression and recoil action. It is understood that many other components can be used to provide this compression and recoil mechanism.

The present invention can provide trucks used on skateboards that better simulate the feeling of surfing, and the unique carving arc that the rocker, rails, and fins of a surfboard create in water. The present invention can also provide a skateboard that gives the user the characteristics and ability of a shortboard to do tricks in bowls and sidewalk skating, as well as the carving ability of a longboard to simulate surfing. The present invention also provides a skateboard that permits the user a great deal of freedom to self-propel forward by pumping the skateboard side to side and front to back in a similar fashion to how surfers gyrate their surfboard to accelerate or stall their surfboards. The skateboards according to the present invention also provide a skateboard with a low center of gravity which can allow improved turning ability while solving the problems associated with wheel bite.

Throughout this description, the preferred embodiment and examples illustrated should be considered as exemplars, rather than as limitations on the present invention. As used herein, the term "invention" or "present invention," refers to any one of the embodiments of the invention described herein, and any equivalents. Furthermore, reference to various feature(s) of the "invention" or "present invention," throughout this document does not mean that all claimed embodiments or methods must include the referenced feature(s).

It is also understood that when an element or feature is referred to as being "on" another element or feature, it can be directly on the other element or feature or intervening elements or features may also be present. It is also understood that when an element is referred to as being "attached," "connected" or "coupled" to another element, it can be directly attached, connected or coupled to the other element or intervening elements may be present. Relative terms, such as "above," "upper" or "lower," and similar terms, may be used herein to describe a relationship of one feature to another. It is understood that these terms are intended to encompass different orientations in addition to the orientation depicted in the figures.

Although the terms first, second, etc. may be used herein to describe various elements or components, these elements or components should not be limited by these terms. These terms are only used to distinguish one element or component from another element or component. Thus, a first element or component discussed below could be termed a second element or component without departing from the teachings of the present invention.

The terminology used herein is for describing particular embodiments only and is not intended to be limiting of the invention. As used herein, the singular forms "a," "an," and "the" are intended to include the plural forms as well, unless the context clearly indicates otherwise. It will be further understood that the terms "comprises," "comprising," when used herein, specify the presence of stated features, integers, steps, operations, elements, and/or components, but do not preclude the presence or addition of one or more other features, integers, steps, operations, elements, components, and/or groups thereof.

Embodiments of the invention are described herein with reference to different views and illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the regions illustrated herein, but are to include deviations in shapes that result, for example, from manufacturing.

Figure 2:
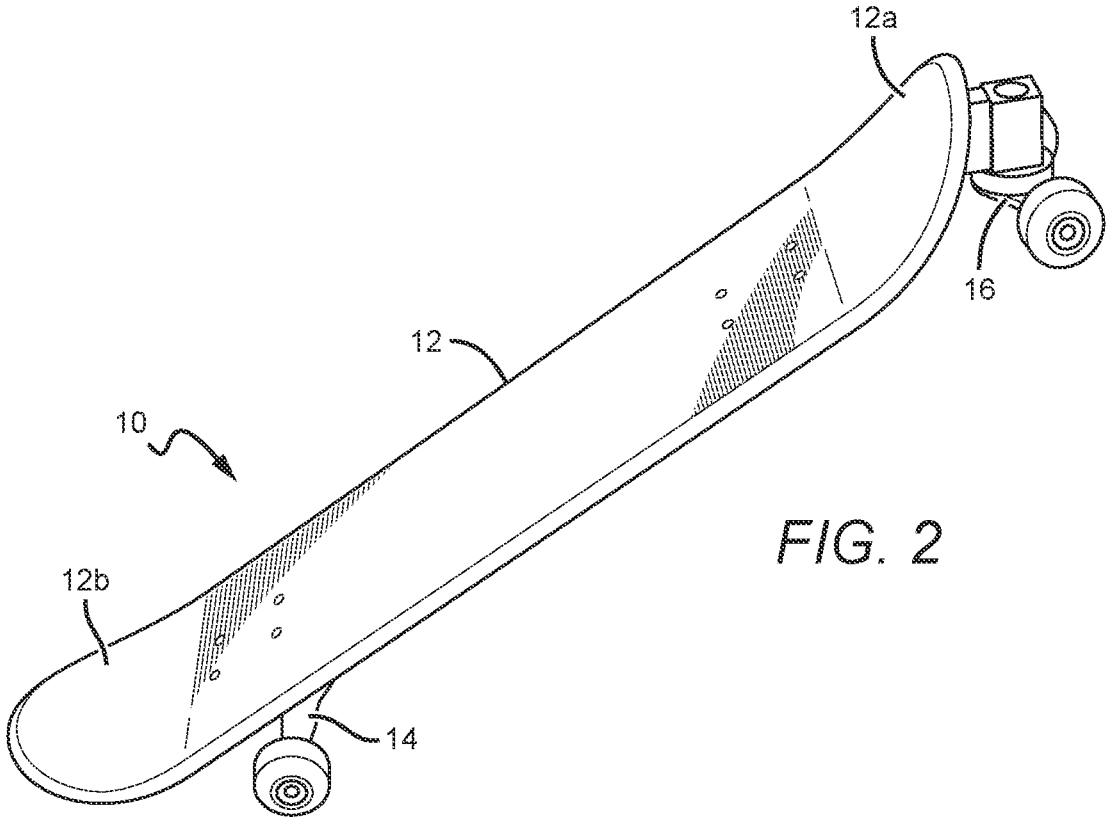
FIG. 2 is top perspective view of one embodiment of a skateboard according to the present invention
Figure 3:
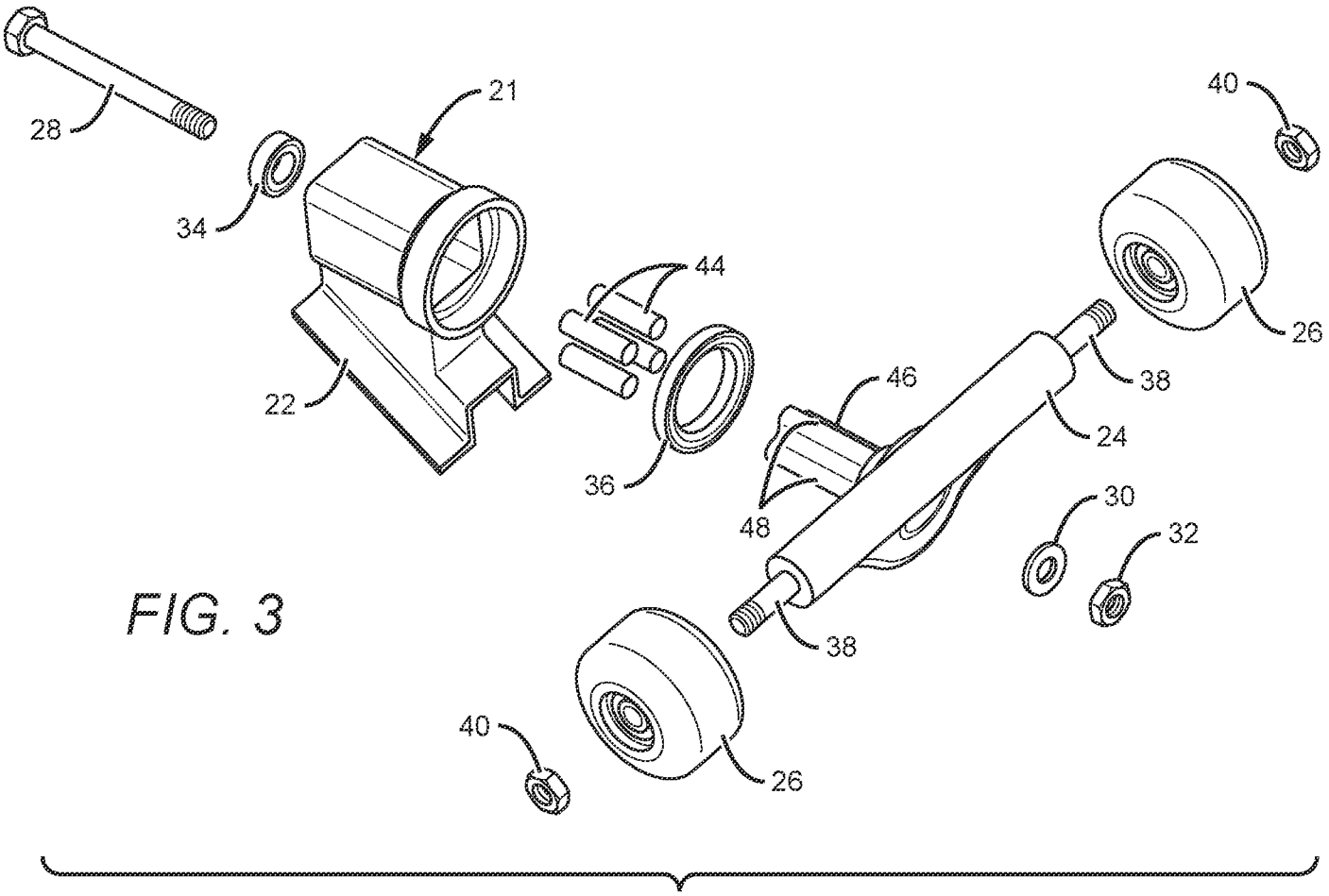
FIG. 3 is a bottom exploded view of one embodiment of a skateboard truck according to the present invention.

FIGS. 1 and 2 show one embodiment of skateboard 10 according to the present invention that comprises a skateboard deck 12, with an angled front kickplate portion 12*a* and angled back kickplate portion 12*b*. The skateboard further comprises a back skateboard truck/wheel assembly ("back truck") 14 that can be a conventional truck/wheel assembly mounted in a standard position using conventional screws or bolts. The skateboard 10 can also comprise a front skateboard truck/wheel assembly ("front truck") 16 according to the present invention that is not mounted in the typical front location 18 but is instead mounted onto the front kickplate portion 12*a* of the skateboard. This particular inventive configuration and positioning better simulates the unique and irregular turning arc of a surfboard created by the rocker, rails and fins.

The positioning of the front truck 16 according to the present invention, along with the shape and of the front hanger and wheel arrangement of the front truck 16 according to the present invention (as described below} allows for an improved turning radius of the device while still providing a skateboard having a lower center of gravity. By placing the truck assembly 16 on the front kickplate, the deck 12 near the front can be lower to the ground compared to conventional skateboards, which can result in the overall skateboard 10 having a lower center of gravity.

In some embodiments, the skateboard deck 12 angles down slightly from the rear kickplate 12*b* to the front kickplate 12*a*. These characteristics can result in the skateboard 10 being more stable in uses such as skate park bowls, roads and sidewalks, compared to some conventional skateboards having a higher center of gravity as described above. The positioning of the front truck 16 on the front kickplate 12*a* also moves the front truck 16 closer to the front end of the deck 12, which increases the distance between the back truck 14 and front truck 16. This increases the wheelbase of the skateboard 10. This arrangement, when used in conjunction with a looser spring system in the front truck (as described below) provides a skateboard 10 with the carving qualities of a long board, the turning abilities and stability of a shortboard and the irregular arc carving qualities of a surfboard on water.

It is understood that in other skateboard embodiments, trucks can also be mounted on the back kickplate, with a conventional truck in the front mounted in a conventional location. In still other embodiments trucks can be mounted to both kickplates.

Figure 4:
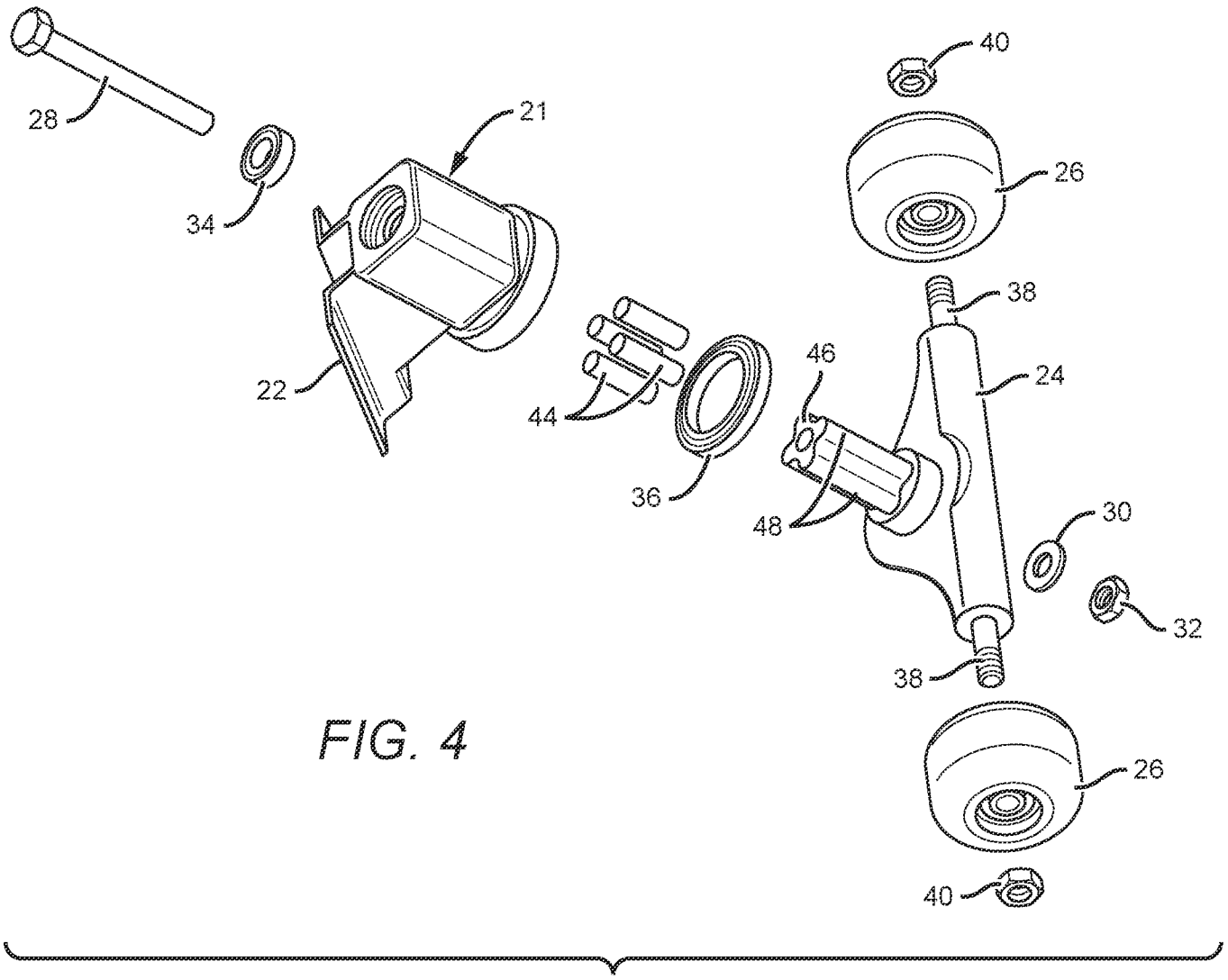
FIG. 4 is a top exploded view of one embodiment of a skateboard truck according to the present invention.
Figure 5:
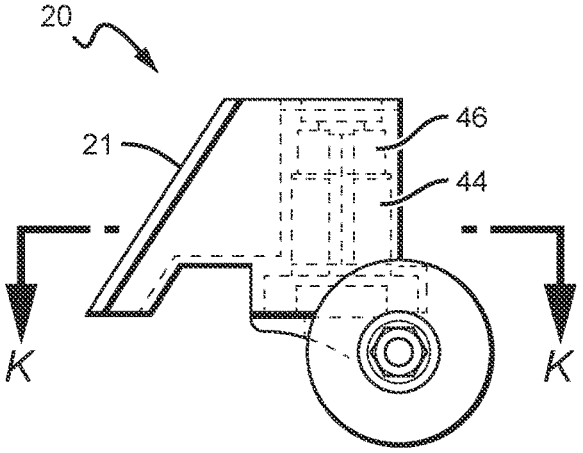
FIG. 5 is a side view of one embodiment of skateboard truck according to the present invention, with its internal or hidden components in phantom.

FIGS. 4 and 5 show one embodiment of truck 20 according to the present invention that comprises base assembly 21 that comprises a base plate 22 for mounting the truck 20 to an angled surface of a skateboard deck, such as to the front skateboard kickplate. It is understood, however, that other embodiments of the truck according to the present invention can comprise base plates arranged similar to those in conventional trucks. The truck 20 also comprises a hanger 24 and wheels 26, arranged so that when the truck is mounted on an angled surface of a skateboard deck, the hanger 24 and wheels 26 are positioned in the desired location to allow the wheels to roll on the ground when the skateboard is in use.

The truck 20 also comprises a bolt 28, washer 30 and nut 32 that cooperate to hold many parts of the truck 20 together. In the embodiment shown, the bolt 28 passes through the base assembly 21 and through a middle hole in the hanger 24. The washer 30 and nut 32 mate with a lower threaded portion of the bolt to hold the hanger 24 and base assembly 21 (as well as intervening components) together to allow the truck 20 to function as desired.

The truck 20 also comprises upper bearings 34 and lower bearings 36 to allow for smooth rotational movement between different parts of the truck 20. Different embodiments of the present invention can use different bearings arranged in many different ways and in different locations on the truck 20. In still other embodiments the truck can comprise other features to allow for smooth operation, such as various bushings or washers. In the embodiment shown, the upper hearing 34 has a smaller diameter than the lower bearing 36, with the upper bearing providing for smooth rotational movement between the head of the bolt 28 and the upper surface of the base assembly 21. The lower bearing 36 is arranged to provide for smooth rotational movement between the hanger 24 and the lower surface of the base assembly 21.

The wheels 26 are mounted on opposing ends of the hanger 24, with each of the wheels 26 having internal wheel bearings that ride on a respective one of the race portions 38 of the hanger 24. Nuts 40 mate with treaded portions of a respective one of the race portions 38 to hold the wheels 26 to the truck 20 in the desired location.

The base assembly 21 according to the present invention has an at least partially hollow housing 42 that in the embodiment shown has a square shaped cross-section. It is understood the hollow housing 42 can have many different cross-section shapes as described in more detail below. The truck 20 also comprises a plurality of rods 44, with different embodiments having different numbers of rods. Each of the rods 44 is positioned within the hollow housing 42, preferably with each of the rods 44 being positioned in corner of the hollow housing 42.

The hanger 24 also comprises a cam portion 46 that is arranged to extend into the hollow housing 42 to cooperate with the rods 44 to allow rotation and recoil of the hanger 24 is relation to the base assembly 21. In the embodiment shown, the cam portion 46 has a plurality of longitudinal walls 48, each of which is positioned between a respective pair of the rods 44. The embodiment shown comprises four rods, so the cam portion 46 also comprises four walls 48. As described in more detail below, as the hanger 24 turns, the walls 48 turn within the housing 42. This in turn causes each of the walls 48 to compress a respective one of the rods 42 between it and one of the inner surfaces of the hollow housing 42. This compression action provides the desired resistance to turning, and the compression of the rods continues until the hanger 24 reaches its maximum turning angle and stops. Once the turning force is removed, the compression force on the rods 42 is removed and the rods are allowed to expand. The expansion of the rods 42 causes the truck to return to its center or neutral position.

Each of the walls 48 is arranged to work on two of the rods 42. Each of the walls 48 is between two rods 44, and when the hanger 24 turns one way each of the walls 48 compresses one of the rods 44 that it is between. When the hanger 24 turns the other way, it compresses the other of the rods 42 that it is between.

It is understood that different embodiments according to the present invention can use rods with different shapes and sizes, that can be made of different compressive materials. In some embodiments, the rods 42 can be made of material such as rubber, polyurethane or other similar materials or combinations of materials. It is understood that the compressive nature (or hardness) of these materials is measured by a Shore/durameter hardness ("durameter hardness"). Durameter hardness is a measure of the resistance of a material to penetration.

For trucks according to the present invention where higher turning resistance is desired, rods with a higher durameter hardness can be used. This can be particularly applicable to skateboards used by a larger user where more turning force is used to compress the rods. Conversely, for trucks where a lower turning resistance is desired, rods with a lower durameter hardness can be used. This can be particularly applicable to skateboards used by smaller users where less turning force is used. It is understood that the different durameter hardness rods can be used based on other considerations beyond the size of the user, such as the desired operational characteristics of the skateboard.

It is also understood that different truck embodiments according to the present invention can be used with different numbers of rods arranged in different ways. In some embodiments, less than four rods can be used, while in other embodiments more than four can be used. The hollow housing for base assembly and the cam portion of the hanger can be shaped differently to accommodate the different numbers of rods.

The present innovative truck assembly relies on the action of compression to allow turning, and expansion and recoiling to return to neutral when the turning force is removed. This turning compression and expansion recoiling action can be provided by many different mechanisms, and the present invention should not be limited to the rod and cam section arrangement described above. The truck arrangements according to the present invention can be shorter than conventional trucks, which can provide alternative uses and applications for the trucks.

Figure 6:
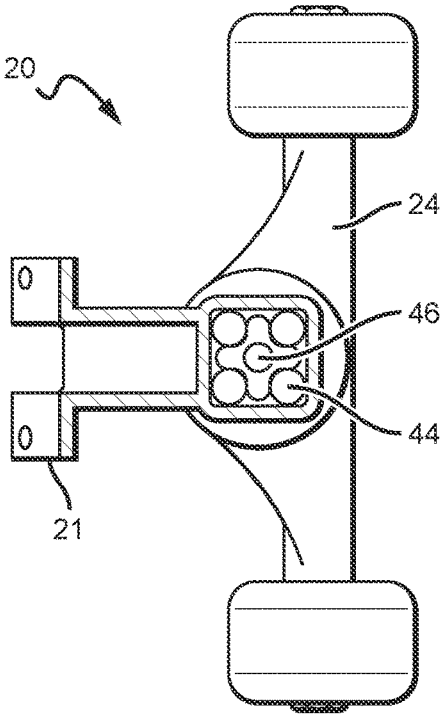
FIG. 6 is a top sectional view of the truck in FIG. 5 taken along second line K-K.

Referring now to FIGS. 5-10, the turning action of the trucks according to the present invention is shown in more detail. FIG. 5 a side view of a truck 20 according to the present invention with a section line K-K base assembly 21, rods 44 and cam section 46. FIG. 6 is a top section view of the truck 20 taken along section line K-K showing the truck 20 in its neutral position with the four rods 44 not compressed by the walls 48 of the cam section 46.

Figure 7:
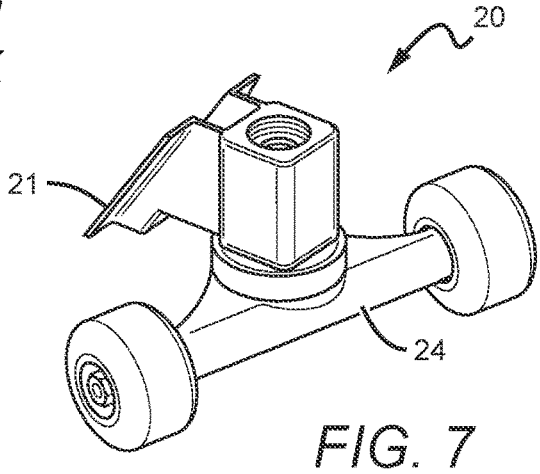
FIG. 7 is a perspective view of the truck in FIG. 5 at a 10-degree turn.
Figure 8:
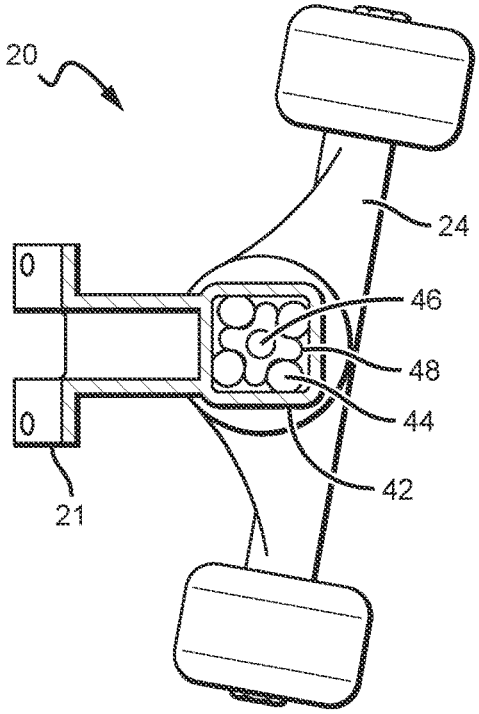
FIG. 8 is sectional view of the truck in FIG. 5 at a 10-degree turn, taken along section line K-K in FIG. 5.

FIG. 7 is a perspective view showing the truck 20 with the hanger 24 having a 10-degree turn in relation to the base assembly 21. Referring now to FIG. 8, the turning of the hanger 24 causes the cam section 46 to turn within the hollow housing 42. This in turn causes each of the walls 48 to compress a respective one of the rods 44 against an internal surface of the hollow housing 42.

Figure 9:
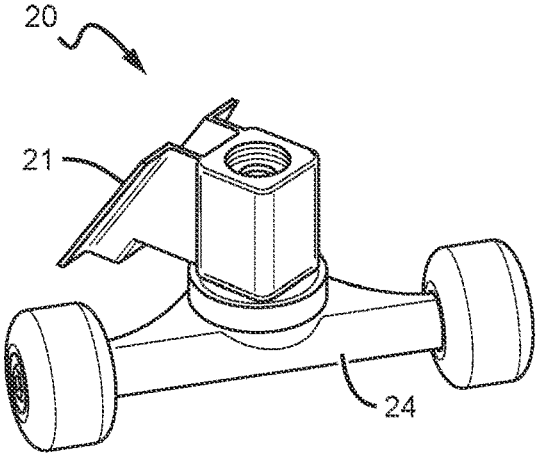
FIG. 9 is a perspective view of the truck in FIG. 5 at its maximum turn.
Figure 10:
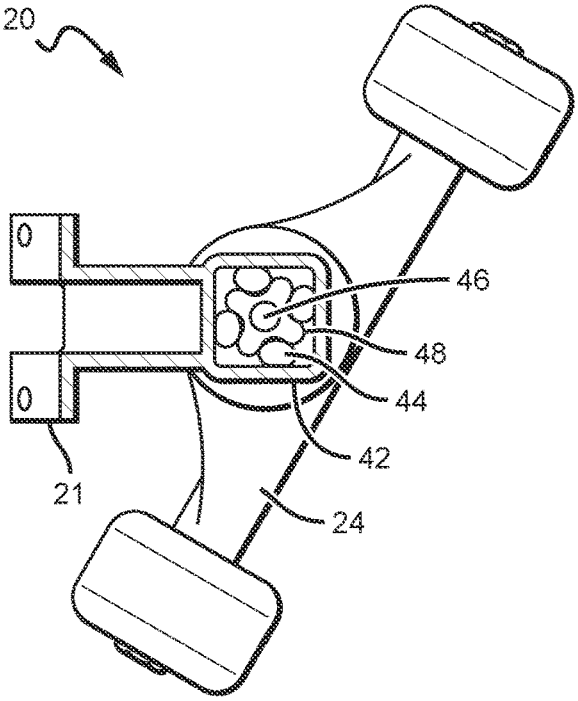
FIG. 10 is a sectional view of the truck in FIG. 5 at its maximum turn, taken along section line K-K in FIG. 5.

FIG. 9 is a perspective view of the truck 20 with the hanger 24 having a 30-degree turn in relation to the base assembly 21. Referring now to FIG. 10, the further turning of the hanger 24 causes the cam section 46 to turn further within the hollow housing 42. This in turn causes each of the walls 48 to further compress a respective one of the rods 44. In the embodiment shown, this 30-degrees of rotation can represent full turn and full compression of the rods 44. As mentioned above, when the turning force is removed, the rods 44 can expand and return the truck 20 to its neutral position.

Figure 11:
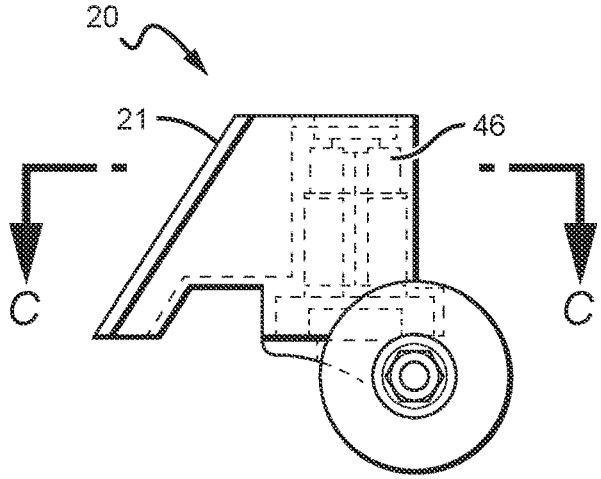
FIG. 11 is a side view of one embodiment of skateboard truck according to the present invention, with its internal or hidden components in phantom.
Figure 12:
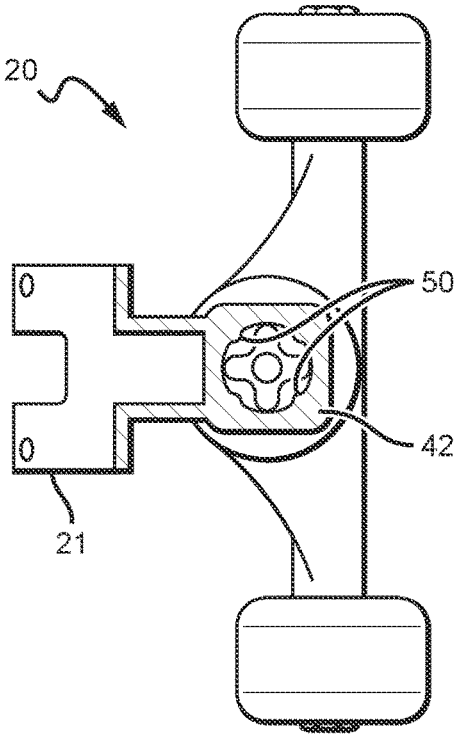
FIG. 12 is a top sectional view of the truck in FIG. 11 taken along second line C-C.

Referring now to FIGS. 11-16, the turning action and stop of the trucks according to the present invention is shown in more detail. FIG. 11 is a side view of a truck 20 according to the present invention with a section line C-C through base assembly 21 and top portion of the cam section 46. The rods 44 shown in the figures above do not extend into this section of the truck but are instead arranged just below this section. FIG. 12 is a top section view of the truck 20 taken along section line C-C showing the truck 20 in its neutral position. This inside surface of the hollow housing 42 has four lateral protrusion 50 that are arranged as stops for the turning motion of the hanger 24 in relation to the base assembly 21.

Figure 13:
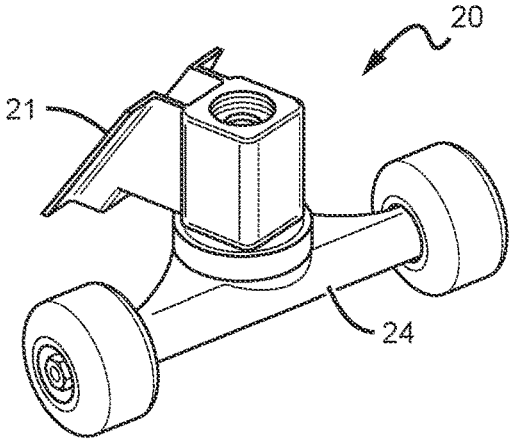
FIG. 13 is a perspective view of the truck in FIG. 11 at a 10-degree turn.
Figure 15:
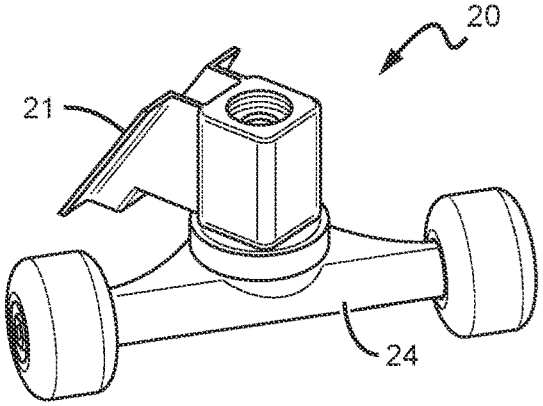
FIG. 15 is a perspective view of the truck in FIG. 11 at its maximum turn.
Figure 14:
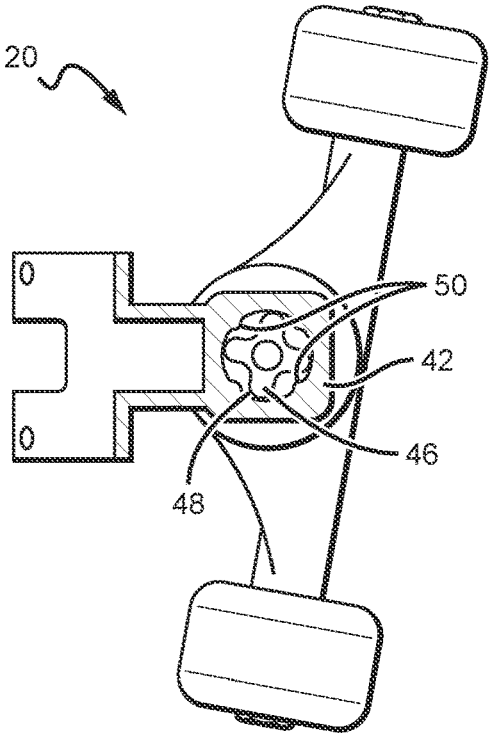
FIG. 14 is sectional view of the truck in FIG. 11 at a 10-degree turn, taken along section line C-C in FIG. 11.
Figure 16:
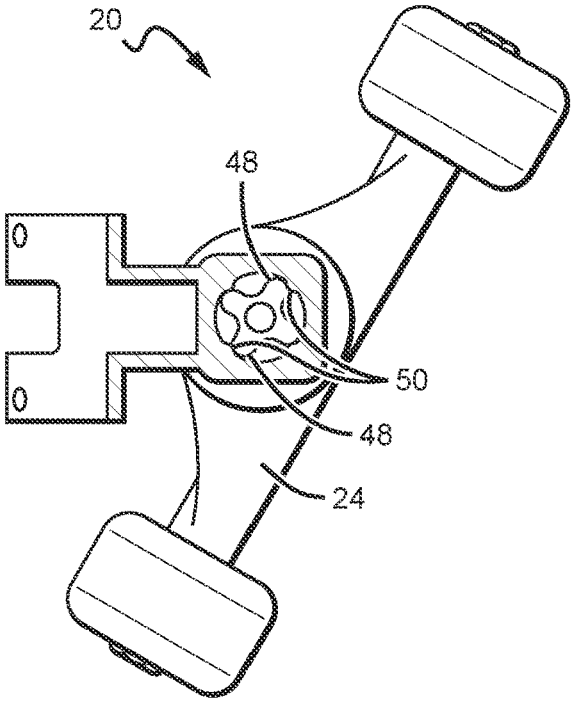
FIG. 16 is a sectional view of the truck in FIG. 11 at its maximum turn, taken along section line C-C in FIG. 11.

FIG. 13 is a perspective view showing the truck 20 with the hanger 24 having a 10-degree turn in relation to the base assembly 21. Referring now to FIG. 14, the turning of the hanger 21 causes the cam section 46 to turn within the hollow housing 42. This in turn causes each of the walls 48 to move closer to one of the protrusions 50. FIG. 15 is a perspective view of the truck 20 with the hanger 24 having a 30-degree turn in relation to the base assembly 21. Referring now to FIG. 16, the further turning of the hanger 24 causes the walls 48 to hit one of the protrusions 50. This acts as stop (or maximum) turning point for the hanger 24 in relation to the base assembly 21.

The geometry will not allow the cam portion 46 to rotate any further, setting the stop turning radius at 30 degrees. This geometry allows maximum turning to occur at 30 degrees, while still not allowing the truck wheels to strike the underside of the skateboard deck when at this maximum turn. This will then prevent "wheel bite' to occur and eliminate this danger that is inherent in skateboards in general.

The rod and cam/wall system described above rolls and compresses the rods in a manner that is smoother, quieter and more gradual compared to a standard two bushing skateboard system in which the bushings are in simple compression. A standard skateboard truck pivots two points similar to a hammock, whereas this two-bearing rotation system in conjunction with the simultaneous rolling and compressing of the polyurethane rods offers a much smoother quieter turning mechanism. By positioning the more loosely turning front truck on the nose of the skateboard deck, in conjunction with a stiffer standard back truck mounted in a standard position, a skateboard is provided that has a closer feel to a surfboard and a low center of gravity and great stability. The skateboard can also be operated to self-propel, and is capable of most of the flip tricks and aerials in bowls and street skating. The skateboard also like a surfboard at the moment that a common skateboard trucks bog down.

It will be apparent to those skilled in the art that various changes may be made without departing from the scope of the invention and the inventions. FIGS. 17-22 show another embodiment of truck 100 that is similar to the truck 20 described above and comprises base assembly 101 that comprises a base plate 102 for mounting the truck 100 to an underside surface of a skateboard deck, such as to a kickplate as described above, or to a conventional mounting. The truck 100 also comprises a hanger 104 and wheels (not shown), arranged so that when the truck is mounted on an underside surface of a skateboard deck, the hanger 104 (and wheels) are positioned in the desired location to allow the wheels to roll on the ground when the skateboard is in use.

The truck 100 also comprises a bolt or kingpin 108, washer 110 and nut 112 that cooperate to hold the truck 100 together. Like the embodiment above, the bolt 108 passes through the base assembly 101 and through a middle hole in the hanger 104. The washer 110 and nut 112 mate with a lower threaded portion of the bolt to hold together the hanger 104 and base assembly 101 (as well as intervening components) together to allow the truck 100 to function as desired.

Figure 17:
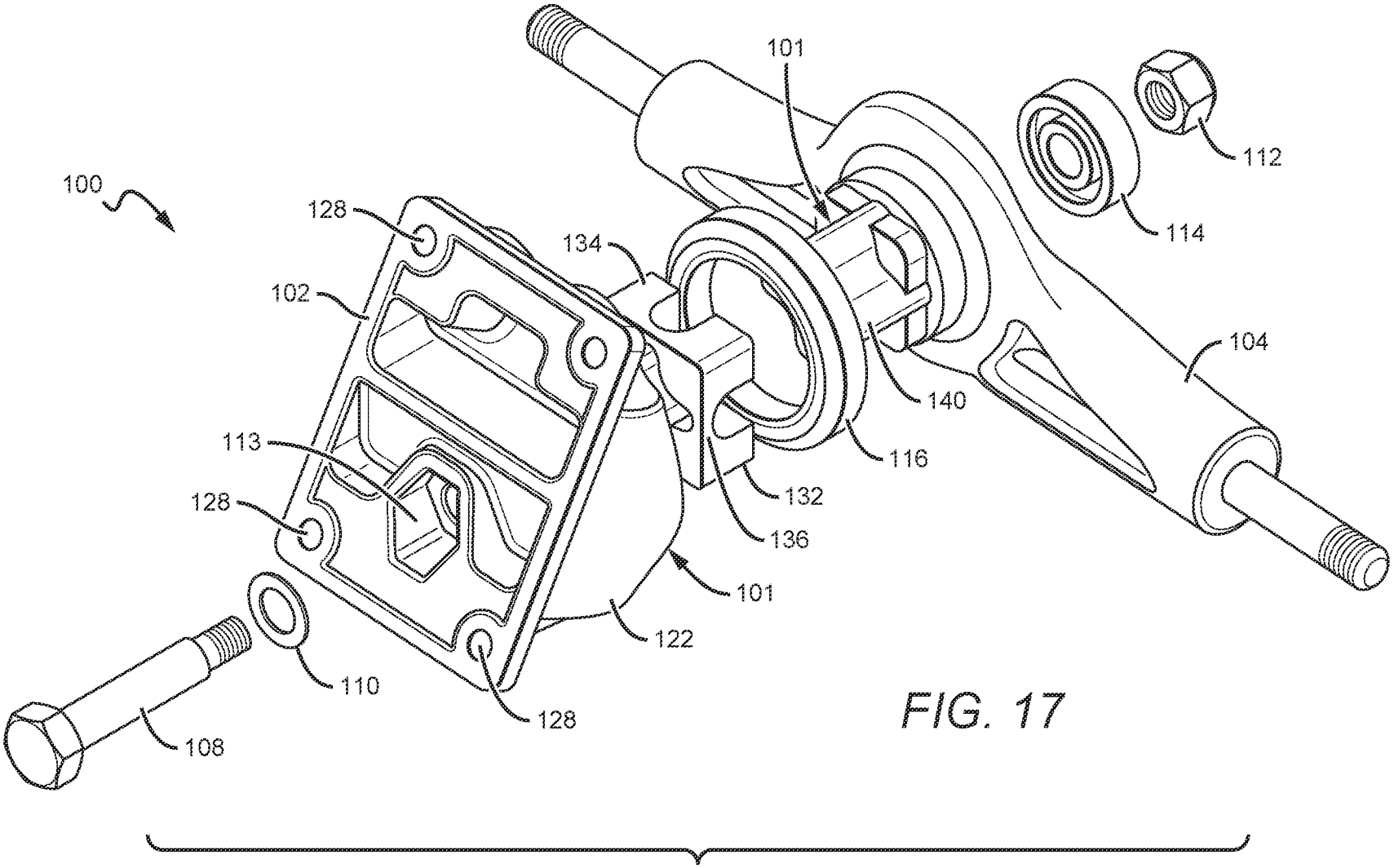
FIG. 17 is an exploded view of another embodiment of a skateboard truck according to the present invention.
Figure 19:
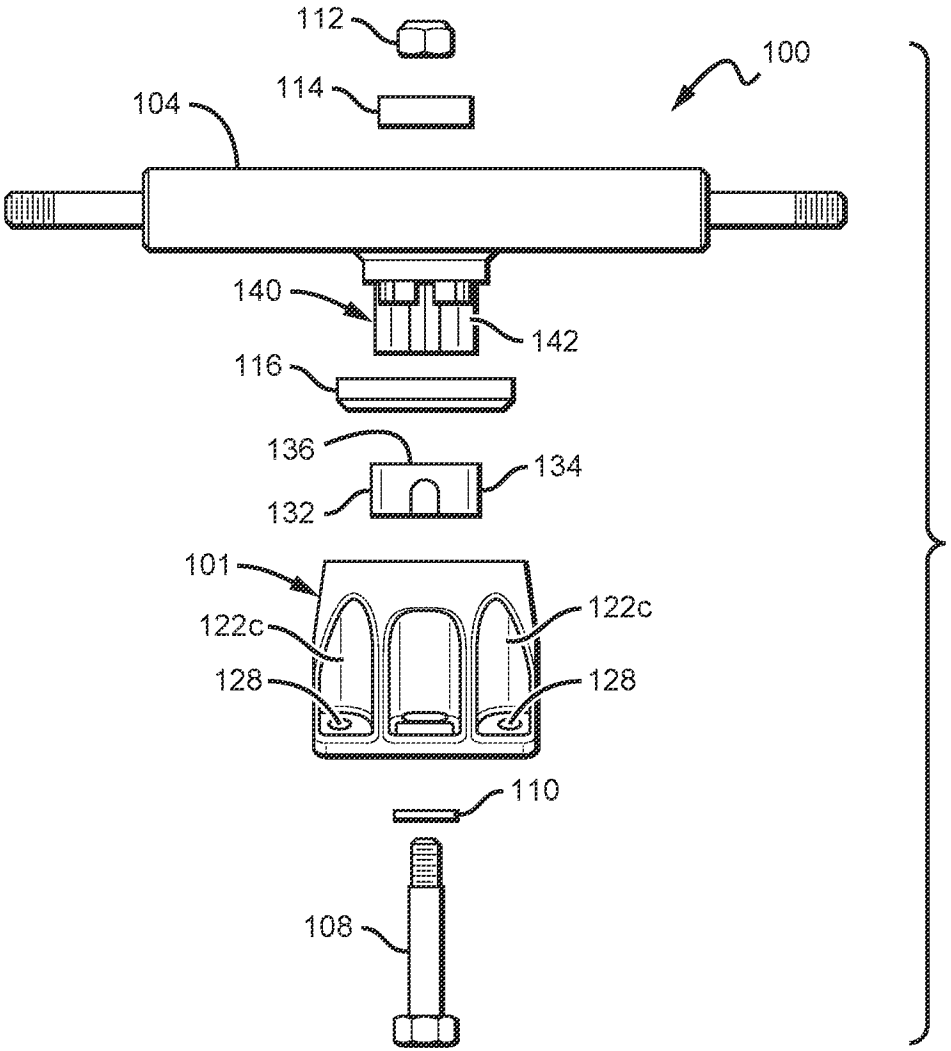
FIG. 19 is an exploded front view of the skateboard truck shown in FIG. 17.
Figure 18:
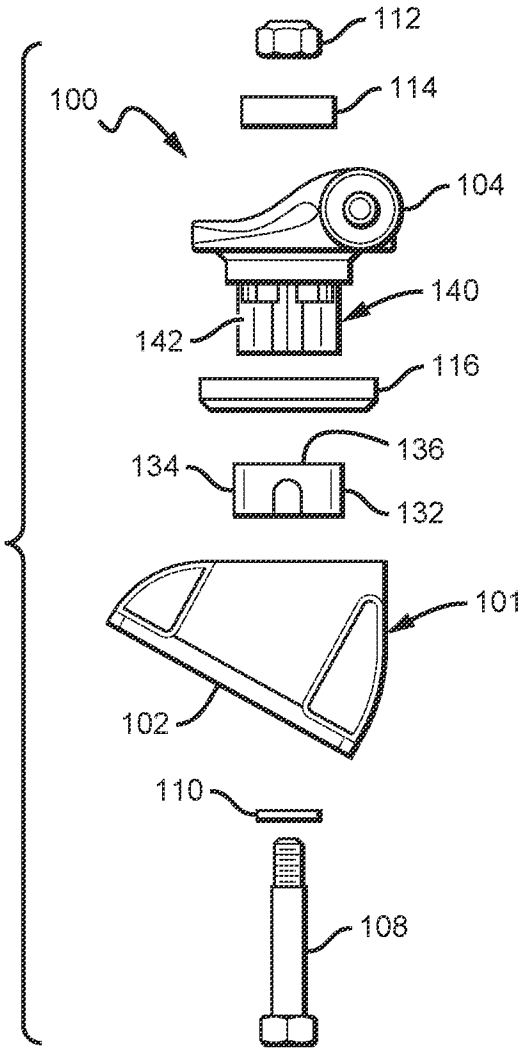
FIG. 18 is an exploded side view of the skateboard truck shown in FIG. 17.
Figure 21:
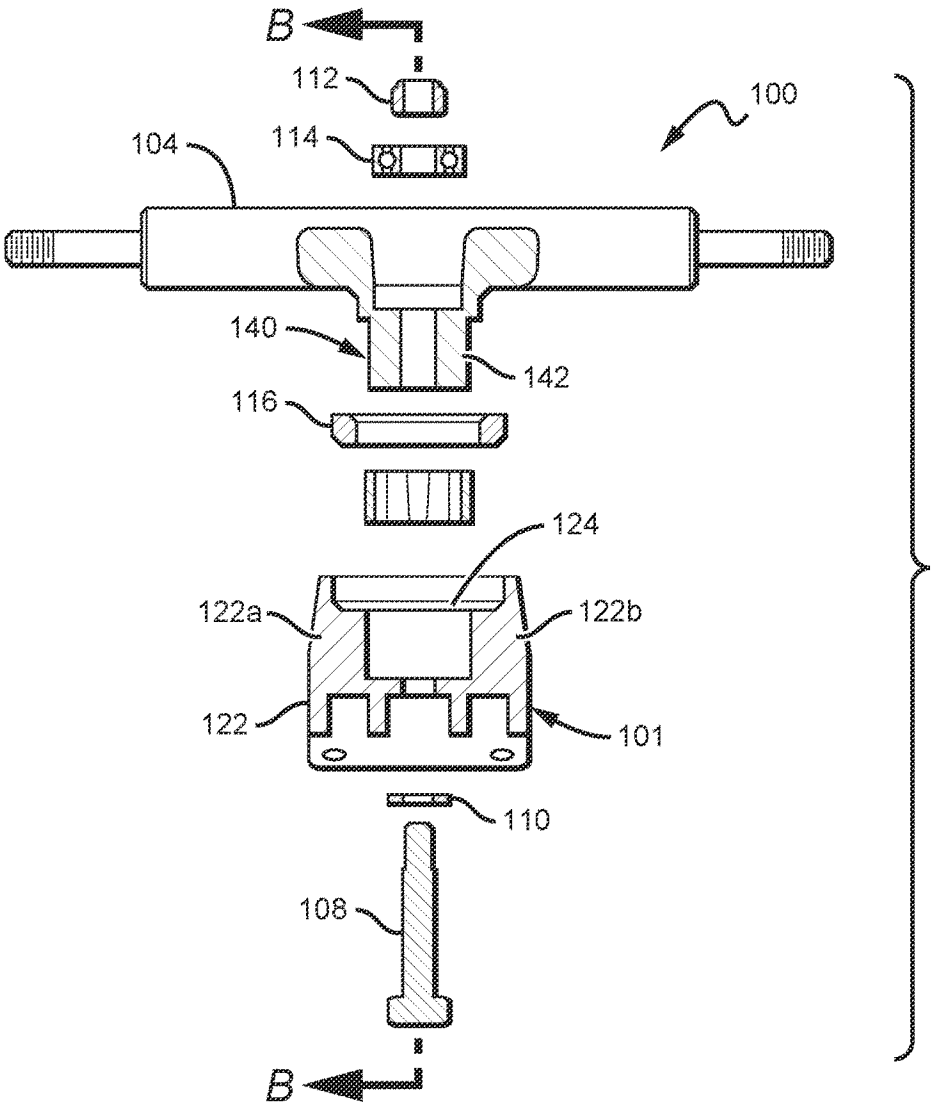
FIG. 21 is sectional view of the truck shown in FIG. 20 taken along section lines A-A.
Figure 20:
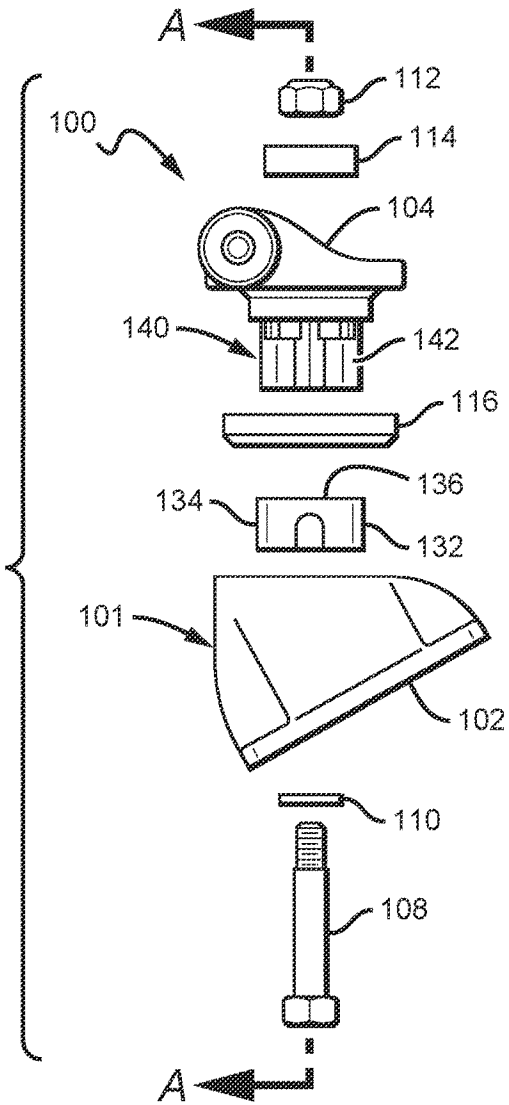
FIG. 20 is another exploded side view of the skateboard truck shown in FIG. 17.

The truck 100 also comprises an upper bearing 114 and lower bearing 116 similar to those described above, and function in much the same way to allow for smooth rotational movement between different parts of the truck 100. However, in this embodiment, the upper bushing 114 is between the nut 112 and the hanger 104, instead of the between the head of the bolt 28 and the base assembly 21 in truck 20 described above. As best shown in FIG. 17, this allows for the base assemble 101 to have a hex shaped opening 113 sized to hold the head of the bolt 108. This arrangement allows for ease of assembly with a single wrench or socket turning the nut 112 onto the bold 108, with the opening 113 holding the head of the bolt 108. As described above, different embodiments of the present invention can use different bearings arranged in many different ways and in different locations on the truck 100, and other features can be included to allow for smooth operation, such as various bushings or washers.

The base assembly 101 according to the present invention has at least partially hollow housing 122 (best shown in FIGS. 21 and 22) that in the embodiment shown has a square shaped cross-section and opening 124 that opens toward the hanger 104. The outside surface 126 of the housing 122 is not square shaped, but instead has a plurality of curved surfaces that can be both aesthetic and functional. For instance, that housing 122 can have thick left and right walls 122*a*, 122*b* for stability, but can also have curved surfaces 122*c* to shape the outer surface of the housing 122 to allow access to mounting holes 128 (best shown in FIG. 19). These are only some of the different shapes that the housing 122 can take in different embodiments according to the present invention.

Figure 23:
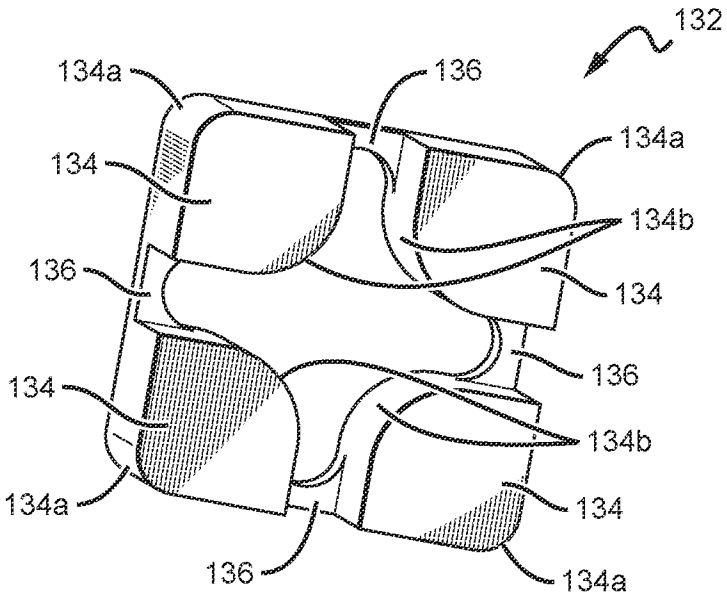
FIG. 23 is a perspective view of one embodiment of a bushing according to the present invention.

The truck 100 operates in much the same way as truck 20 above by the action of a cam portion 140 of the hanger 104 compressing elements internal to the housing 122 during the turning of the skateboard. The compressible elements also expand and return the truck to a neutral position when the turning force is removed. Referring now to FIG. 23 in conjunction with FIGS. 17-22, instead of having a plurality of rods 44 as described above in truck 20, the truck 100 comprises a bushing 132 having four rod-like components 134 that can be arranged to operate in much the same way as the rods 44 described above. In this embodiment, each of the components 134 is connected by a band 136, such that the bushing 132 is a single integrated device. The bushing 132 can comprise many different materials similar to the rods 44, including but not limited to rubber, polyurethane or other similar materials or combinations of materials. It is also understood that the bushing material can have the different Shore/durameter hardness just as the rods 44. Like the rods 44, the bushing 132 can have different portions made of different materials and different hardness.

The integrated bushing 132 can have certain advantages over the use separate rods, such as ease of handling during assembly and repair of the truck 100. Instead of using four different rods that need to be placed in the desired location within the housing 122, a single bushing can be placed in the housing. Further, the bushing can be compressible during insertion in the housing 122 and can then expand to the desired location in the housing 122. The outward pressure of the bands 136 can hold the bushing in place such that the bushing will not move or fall from the desired location. This can make insertion of the bushing 132 and the following assembly steps easier and more convenient compared to the use of rods.

The hanger 104 also include a cam portion 140, and like the rods, each of the components 134 can be arranged to fit in a corner of the square shape opening 124. The components 134 can also be shaped to closely fit the surface of square shaped opening 124 and the surfaces of the cam portion 140. In the embodiment shown, each component 134 can have a curved outside surface 134*a* that matches the curve in a corner of the square shaped opening 124. The inside surface of each component 134 has curved inside surface 134*b* that matches a curved surface of the cam portion 140. This matching of surfaces allows for the components 134 to substantially fill the space between the opening 124 and the cam 140 to provide for efficient and responsive compression and expansion operation during turning of the skateboard. It is also understood that the components 134 can take many different shapes according to the present invention, some of which can less closely fit the surface of the opening 124 and the cam 140, and can fill less than substantially all of the space between the opening 124 and the cam 140.

Like the cam portion 46 described above, cam portion 140 can be arranged to extend into the square shaped opening 124 of the housing 122 to cooperate with components 134 to allow rotation and recoil of the hanger 104 is relation to the base assembly 101. The cam portion 140 has a plurality of longitudinal walls 142, each of which is positioned between a respective pair of the components 134. The walls 142 and components 134 cooperate as described above to provide compression of the components during turning and expansion as described above to return the truck to its center or neutral position. Each of the walls 142 is arranged to work on two of the components, depending on which way the skateboard is being turned.

It is also understood that different truck embodiments according to the present invention can be used with different numbers of rods arranged in different ways. In some embodiments, less or more than four components can be used. The hollow housing 124 for base assembly and the cam portion 140 of the hanger can be shaped differently to accommodate the different numbers of rods. It is understood that the present invention should not be limited to the component and cam arrangements described above.

Figure 24:
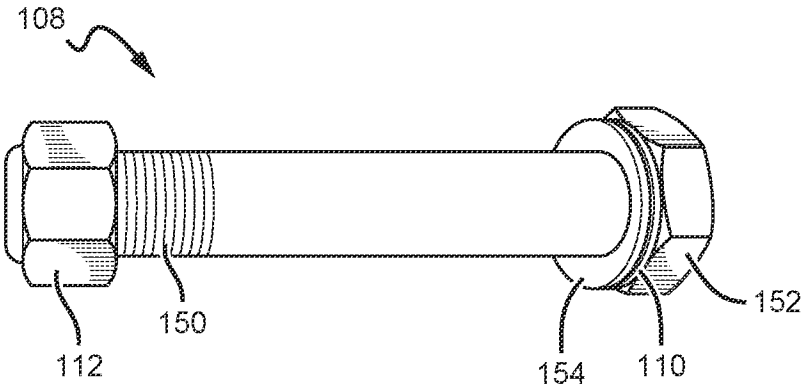
FIG. 24 is a side view of one embodiment of a bolt and nut assembly according to the present invention.
Figure 22:
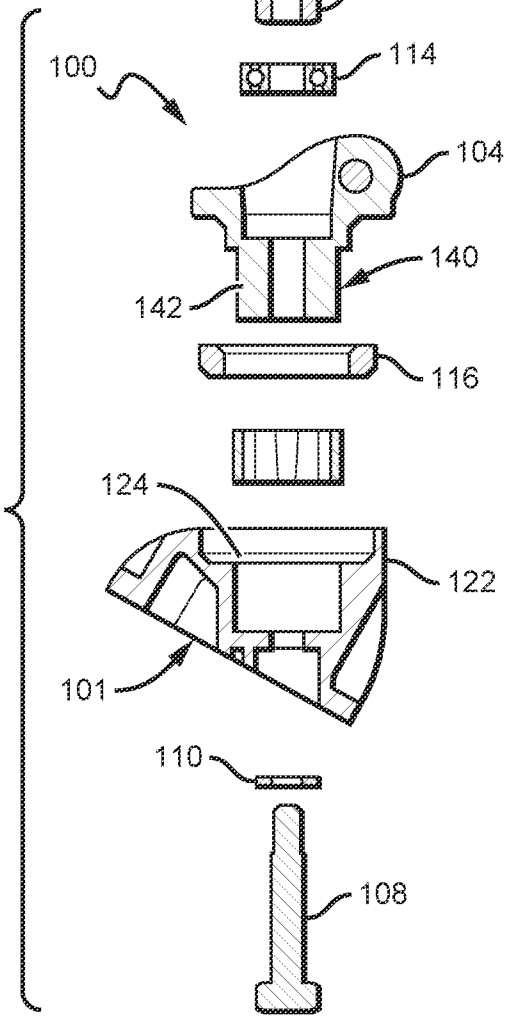
FIG. 22 is a sectional view of the truck shown in FIG. 21 taken along section lines B-B.

The truck 100 can also have additional features that can be arranged to provide the desired operation characteristics. Referring now to FIG. 24, one embodiment of the bolt or kingpin 108, washer 110 and nut 112 are shown in more detail. In this embodiment, the nut 112 is a conventional hex-head type, and the bolt 108 comprises a threaded portion 150 at its end opposite the bolt head 152. The transition from the threaded portion 120 to the remainder of the bold 108 acts as a threading limiter so that the nut 112 cannot be turned onto the bolt 108 past the transition. This limits the extent to which that 112 and bolt 108 can be tightened on the truck 100, to prevent overtightening of the upper bearing 114 and lower bearing 116. Is addition to the washer 110, the bolt can include a spring washer 154, to reduce stress at the interface between the bearing 115 and nut 112 during operation. Many different spring washers can be used, such as conventionally available Belleville washers.

It is understood that the present invention should not to be considered limited to what is shown and described in the specifications, drawings or figures. One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations of the scope. Changes therein and other uses will occur to those skilled in the art which are encompassed within the spirit of the invention. Although the invention has been described in connection with specific preferred embodiments it should be understood that the invention as claimed should not be unduly limited to such specific embodiments.

We claim:

1. A skateboard truck, comprising:

a hanger with wheels;

a base assembly, having an at least partially hollow housing section, wherein said hanger is rotationally mounted to said base assembly, with said hanger comprises a hanger portion within said at least partially hollow housing section; and integral bushing within said at least partially hollow housing section, wherein said hanger portion operates on said bushing when said hanger rotates in relation to said base assembly, wherein said integral bushing comprises a plurality of compressible components coupled together with a plurality of bands.

2. The truck of claim 1, wherein each of said bands runs between adjacent compressible components.

3. The truck of claim 1, wherein said hanger portion compresses said compressible components when said hanger rotates in relation to said base assembly.

4. The truck of claim 3, wherein said compressible components are compressed between said hanger portion and the inside surface of said partially hollow housing section.

5. The truck of claim 1, wherein said hanger has a neutral position in relation to said base assembly, wherein said hanger rotates in relation to said base assembly under a turning force, said truck returning to said neutral position when said turning force is removed.

6. The truck of claim 3, wherein expansion of said compressible components causes said hanger to return to said neutral position.

7. The truck of claim 1, wherein said hanger portion comprises walls to compress said compressible components when said hanger rotates in relation to said base assembly.

8. The truck of claim 1, wherein said hanger portion comprises a cam section.

9. The truck of claim 1, further comprising upper and lower bearings, with one of said upper and lower bearings is between said hanger and said base assembly.

10. A skateboard truck, comprising:

a hanger rotatably mounted to a base assembly; and bushing internal to said base assembly and at least partially comprising a compressible material, wherein a turning force on said hanger causes said hanger to rotate in relation to said base assembly, which causes compression of said at least part of said bushing, and wherein removal of said turning force allows at least a portion of said bushing to expand to cause said hanger to return to a neutral position in relation to said base assembly, wherein said bushing comprises a plurality of connected compressible components.

11. The truck according to claim 10, wherein said base assembly comprises a hollow section holding said bushing, and wherein said hanger and said hollow section causes said compression of at least a portion of said bushing.

12. The truck of claim 11, wherein said bushing is compressed between said hanger and the inside surface of said hollow section.

13. The truck of claim 10, wherein said plurality of connected compressible components comprises a plurality of compressible components with bands running between.

14. The truck of claim 13, wherein said compressible components and bands comprise an integral bushing.

15. The truck of claim 10, wherein said hanger and said base assembly are held together by bolt and nut, wherein said bolt is arranged to prevent overtightening.

16. The truck of claim 15, further comprising a spring washer on said bolt.

17. The truck of claim 15, wherein said base assembly comprises a hex shaped opening for the head of said bolt.

18. A skateboard, comprising:

a skateboard deck;

a truck mounted to the underside of said deck, said truck comprising a hanger with wheels;

a base assembly, having an at least partially hollow housing section, wherein said hanger is rotationally mounted to said base assembly, with said hanger comprises a hanger portion within said at least partially hollow housing section; and integral bushing within said at least partially hollow housing section, wherein said hanger portion operates on said bushing when said hanger rotates in relation to said base assembly, wherein said integral bushing comprises a plurality of compressible components coupled together with a plurality of bands.

* * * * *